US006276778B1

(12) United States Patent
Katayama

(10) Patent No.: US 6,276,778 B1
(45) Date of Patent: Aug. 21, 2001

(54) PRINTING APPARATUS

(75) Inventor: Yoshiki Katayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/342,139

(22) Filed: Jun. 29, 1999

(30) Foreign Application Priority Data

Jun. 30, 1998 (JP) ..... 10-184741

(51) Int. Cl.[7] ..... B41J 2/165

(52) U.S. Cl. ..... 347/28; 347/29; 347/35; 347/36

(58) Field of Search ..... 347/28, 29, 33, 347/35, 36

(56) References Cited

U.S. PATENT DOCUMENTS 5,896,143 * 4/1999 Matsui et al. ..... 347/24

FOREIGN PATENT DOCUMENTS

A2-0 585 923 3/1994 (EP) .

A2-0 822 086 2/1998 (EP) .

* cited by examiner

*Primary Examiner*—N. Le
*Assistant Examiner*—Shih-Wen Hsieh
(74) *Attorney, Agent, or Firm*—Oliff & Berridge, PLC

(57) ABSTRACT

The invention provides a printing apparatus of a portable type, for example, having a carriage capable of moving print heads back and forth in a printing area in the main scanning directions while the print heads, aligned in the main scanning directions, eject inks onto a print sheet, and ink collecting devices for collecting waste ink ejected from nozzles of the print heads during a flushing operation where the nozzle openings are cleaned by ejecting the inks. In one embodiment, a first flushing a for the flushing operation is provided outwardly of the right-side end of the printing area. The first flushing area has an area corresponding to the right-side one of the two print heads. A second flushing area is provided outwardly of the left-side end of the printing area, and has an area corresponding to the left-side print head. Provision of the divided flushing areas reduces the area needed for the movements of the carriage.

8 Claims, 9 Drawing Sheets

D1
16
15
16
15

D2
42
41
16
15
16
15

D3
44
16
15
16
15

D4
102
101
100
102
101
100

D5
42
41
102
101
100
102
101
100

D6
44
102
101
100
102
101
100
43
PW 106
105
104
103
D7
D8
D9
D10
42
41
44
43
PW

PRINTING APPARATUS

BACKGROUND OF THE INVENTION

1. Field of Invention

The invention relates to a flushing mechanism for a print head of an ink jet type or the like.

2. Description of the Related Art

Some ink jet printers that perform printing by ejecting ink from nozzles of a print head while moving the print head back and forth have measures for preventing nozzle clogging caused by increases in ink viscosity that are caused by, for example, dry ink in nozzles that are less frequently operated, or the like. In such an ink jet printer, the flushing operation for recovering the ink ejecting performance of all the nozzles of the print head is periodically performed by withdrawing the print head into a flushing area and causing the nozzles to eject ink to an ink absorber member provided in the flushing area.

In the flushing operating, all the nozzle openings of a print head are cleaned by ejecting ink from the nozzles. Therefore, the flushing operation cannot be performed in a printing area, so that a flushing area needs to be provided separately from the printing area. In the ink jet printers of this type, a flushing area is provided contiguously or continuously to an end of the printing area, and the print head is moved beyond the printing area into the flushing area in order to perform the flushing operation.

Some ink jet printers have a plurality of print heads for performing color printing by ejecting a plurality of color inks from the heads. In such ink jet printers, a plurality of print heads are disposed in the main scanning directions on a carriage. Therefore, in an ink jet printer having a plurality of print heads, all the print heads are withdrawn to the flushing area in order to perform the flushing operation.

However, since the flushing area is provided outwardly of the printing area, the width of the printing apparatus becomes relatively great because of the space for the flushing area in addition to the area needed for the carriage to reciprocate during print operation. Therefore, the printing apparatuses, especially printing apparatuses having a plurality of print heads, tend to become large in size and impede the pursuit of a compact apparatus design, failing to meet recent user's demands for easy transportation of a printing apparatus (printer) together with a mobile-type personal computer.

Furthermore, the moving distance of the carriage also increases, which is undesirable for improvement of paper throughput.

SUMMARY OF THE INVENTION

Accordingly, one aspect of the invention is to provide a high-quality printing apparatus capable of performing periodical flushing operation and performing a clogging-free smooth printing operation without impeding the pursuit of a compact apparatus design.

In accordance with the invention, a printing apparatus includes a carriage being reciprocatable in main scanning directions and being capable of carrying thereon print heads aligned in the main scanning directions, and an ink collecting device that collects waste ink ejected from the print heads during a flushing operation of cleaning a nozzle opening by ejecting ink from a nozzle of the print heads. A first flushing area is provided outwardly of an end of a printing area where the print heads are moved in the main scanning directions. The first flushing area has an area corresponding to at least one print head of the print heads, and is provided with an ink collecting device. A second flushing area is provided outwardly of another end of the printing area. The second flushing area has an area corresponding to the print heads excluding the at least one print head, and is provided with an ink collecting device.

Since the printing apparatus of the invention adopts divided flushing areas for the print heads, instead of a single flushing area having an area corresponding to all the print heads, the printing apparatus is capable of performing the flushing operation within the range of movements of the carriage needed for normal printing. Therefore, the printing apparatus eliminates the need to separately provide a moving range of the carriage for the flushing operation. Furthermore, the invention makes it possible to construct a printing apparatus capable of performing the flushing operation to prevent the clogging of the print heads while securing only the carriage moving area needed for printing. Therefore, it becomes possible to provide a compact, easy-to-carry printing apparatus capable of producing high-quality printing.

In the printing apparatus of the invention, the number of the print heads may be two. In this case, the first flushing area has an area corresponding to one of the print heads, and the second flushing area has an area corresponding to the other one of the print heads.

Thus, the divided flushing areas are provided on both sides so that the flushing operation in each flushing area is performed on the corresponding one of the two print heads, the printing apparatus needs a smaller range of movements of the carriage than a conventional printer wherein a single flushing area for the two print heads is provided on one side. Therefore, it becomes possible to provide a compact printing apparatus capable of producing high-quality printing.

The number of the print heads may also be three. In this case, the first flushing area may have an area corresponding to one of the print heads, and the second flushing area may have an area corresponding to the other two of the print heads.

Since the divided flushing areas are provided on both sides so that the flushing operation is performed on the predetermined one of the three print heads in the first flushing area and on the other two print heads in the second flushing area, the printing apparatus needs a smaller range of movements of the carriage than a conventional printer wherein a single flushing area for all the three print heads is provided on one side. Therefore, it becomes possible to provide a compact printing apparatus capable of producing high-quality printing.

The number of the print heads may also be four. In this case, the first flushing area may have an area corresponding to two of the print heads, and the second flushing area may have an area corresponding to the other two of the print heads.

Since the divided flushing areas are provided on both sides so that the flushing operation in each flushing area is performed on the corresponding two of the four print heads, the printing apparatus needs a smaller range of movements of the carriage than a conventional printer wherein a single flushing area for all the four print heads is provided on one side. Therefore, it becomes possible to provide a compact printing apparatus capable of producing high-quality printing.

If the number of the print heads is four, the first flushing area may have an area corresponding to one of the print heads, and the second flushing area may have an area corresponding to the other three of the print heads.

Since the divided flushing areas are provided on both sides so that the flushing operation is performed on the predetermined one of the four print heads in the first flushing areas and on the other three print heads in the second flushing area. Therefore, the printing apparatus needs a smaller range of movements of the carriage than a conventional printer wherein a single flushing area for all the four print heads is provided on one side. Therefore, it becomes possible to provide a compact printing apparatus capable of producing high-quality printing.

In the printing apparatus of the invention, the flushing operation of at least one print head of the print heads may be performed simultaneously with a printing operation of the print heads other than the at least one print head.

Therefore, it becomes possible to perform the flushing operation without stopping the printing operation. Hence, the time consumed solely for the flushing operation can be reduced, and the throughput time can be reduced.

Further, the ink collecting device may be formed by an ink absorber having a plurality of gaps.

Therefore, it becomes possible to provide a simple construction of the flushing areas and it becomes possible to provide a compact printing apparatus capable of producing high-quality printing.

The ink collecting device may also include a suction device that produces a negative pressure for sucking ink.

Therefore, if the printing apparatus has a purge mechanism, the area for the purge operation can be used for the flushing operation. Hence, it becomes possible to perform the flushing operation without separately providing a flushing area.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Figure 1:
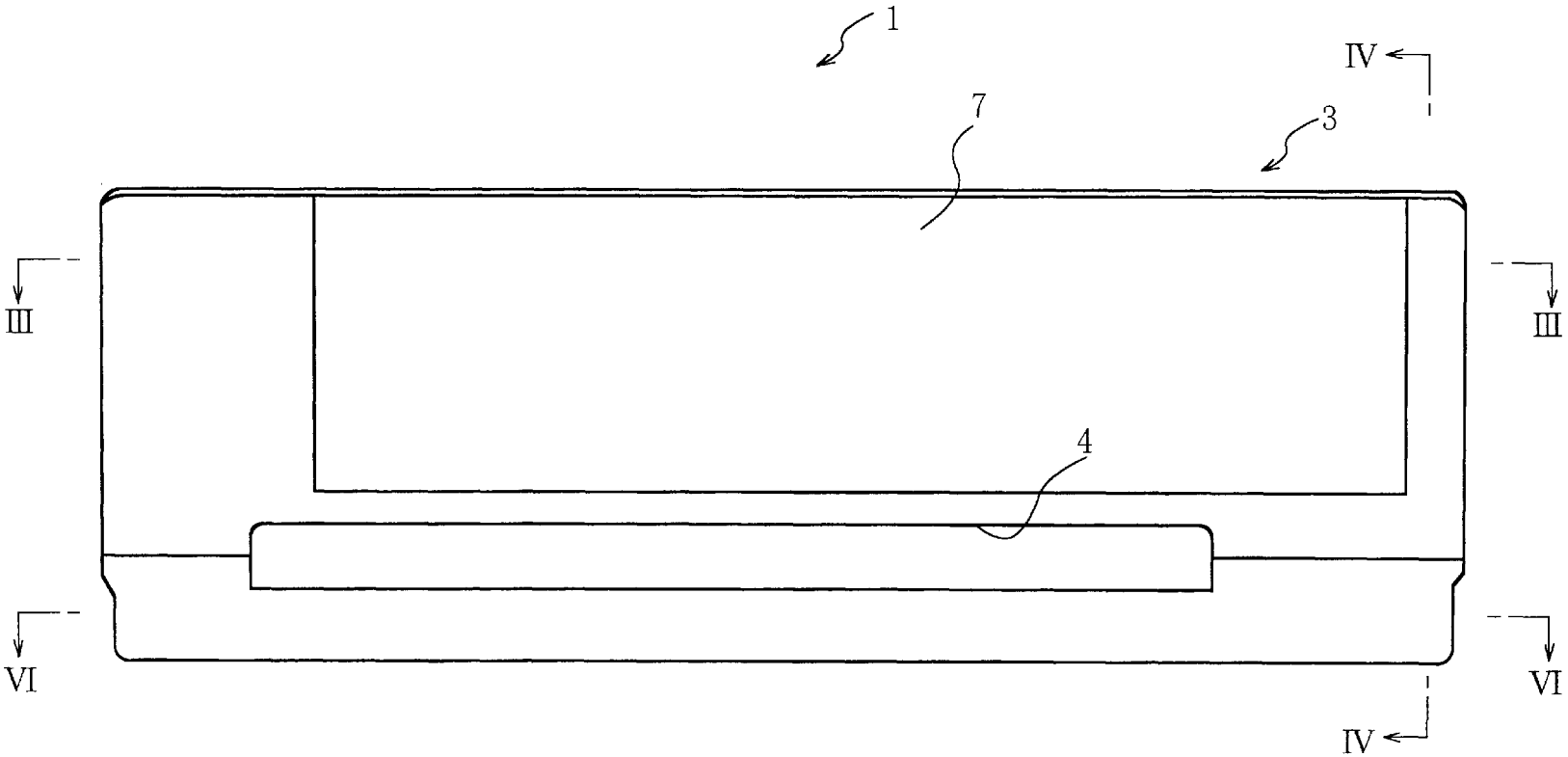
FIG. 1 is a front view of an exterior of a portable printer according to an embodiment of the invention.
Figure 2:
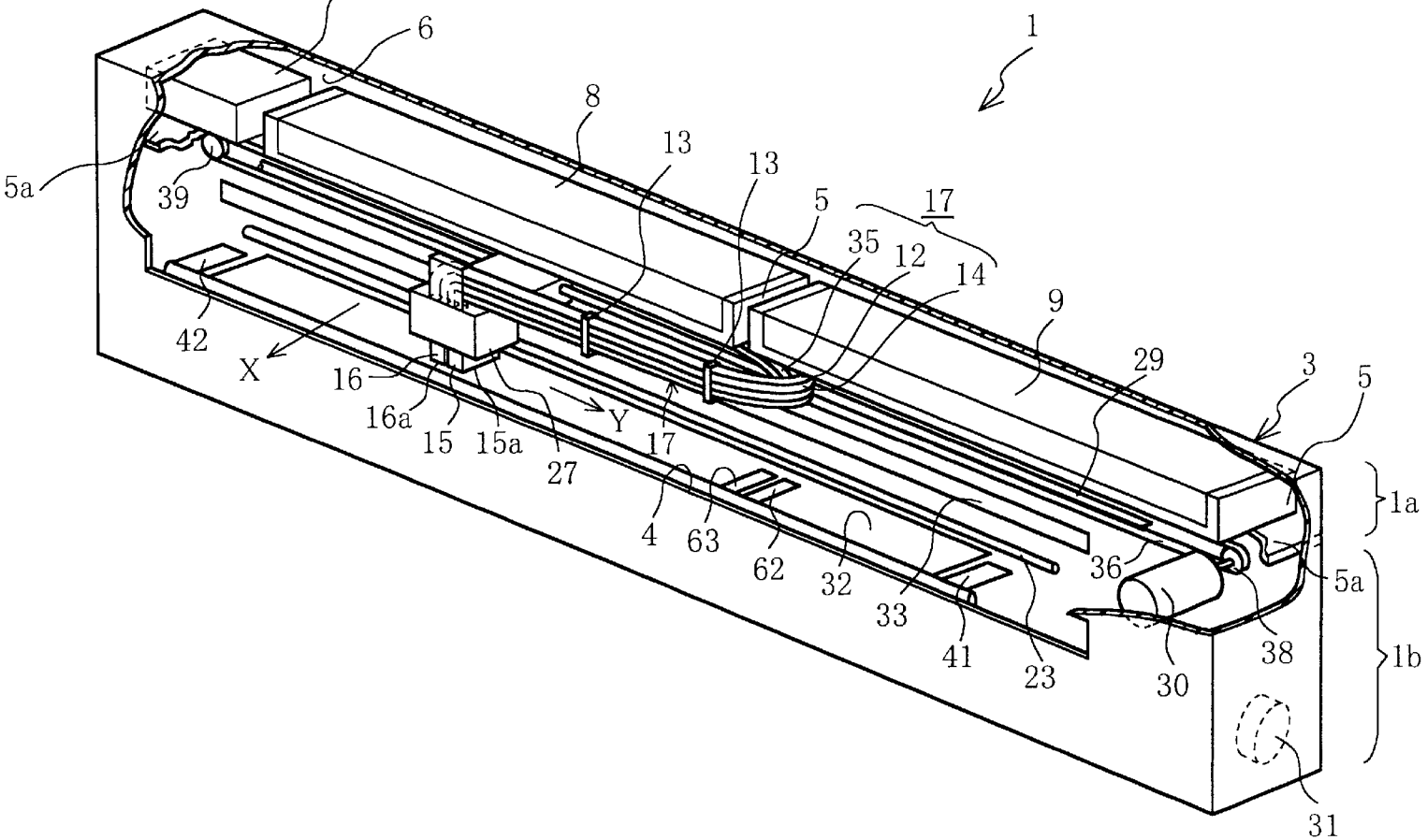
FIG. 2 is a partially cutaway perspective view of the portable printer for schematic illustration of an internal structure of the printer.

A first preferred embodiment of the invention will be described with reference to FIGS. 1 through 8. As best shown in FIGS. 1 and 2, a portable printer 1 has therein a large ink cartridge 8 and a small ink cartridge 9 (hereinafter, collectively referred to as "ink cartridges 8/9") that are disposed at predetermined positions. The portable printer 1 performs printing by supplying inks from the ink cartridges 8/9 to a right-side print head 15 and a left-side print head 16 (hereinafter, referred to as "print heads 15/16"), and ejecting inks from right-side nozzles 15*a* and left-side nozzles 16*a* (hereinafter, referred to as nozzles 15*a*/16*a*) arranged in the print heads 15/16 to a print sheet PP while moving a carriage 27 that supports the print heads 15/16 back and forth in main scanning directions perpendicular to the direction of sheet conveyance.

FIG. 1 is an external front elevation of the portable printer 1 according to the embodiment of the invention. The portable printer 1 has a printer body 3 that is a case having a generally rectangular box shape. Formed in a substantially central portion in a lower portion of the printer body 3 is a sheet discharge opening 4 having a generally rectangular shape that is elongated in the directions of the length of the portable printer 1 (right-to-left directions in FIG. 1). The sheet discharge opening 4 is an opening for discharging the print sheet PP after printing. The elongated width of the sheet discharge opening 4, that is, the dimension thereof in the directions of the length of the portable printer 1, is defined corresponding to the width of the print sheet PP. In the portable printer 1 of the embodiment, the elongated width of the sheet discharge opening 4 is greater than the width of the A4-size sheets (about 210 mm). An upper portion of the printer body 3 has a lid 7 for replacement of the ink cartridges 8/9.

FIG. 2 is a partially cutaway schematic perspective view of an internal structure of the portable printer 1. In FIG. 2, an arrow X indicates the direction of conveyance of the print sheet PP, and an arrow Y indicates a moving direction of the print heads 15/16 during main scanning.

As shown in FIG. 2, the printer body 3 also serves as a body frame 6 having a generally rectangular box shape. Generally rectangular shelf-shaped cartridge frames 5 are disposed in an upper space 1*a* of the body frame 6. A partition 5*a* extends below the cartridge frames 5 throughout substantially the entire length of the body frame 6 along a rearward side thereof, separating the upper space 1*a* from a lower space 1*b*. The partition plate 5*a* defines an opening in front thereof, whereby the upper space 1*a* communicates with the lower space 1*b*. The ink cartridges 8/9 are arranged horizontally on the cartridge frames 5, with their upper ends being flush with one another.

Disposed in the lower space 1*b* of the body frame 6 of the portable printer 1 is the carriage 27 movable back and forth within the printer body 3 in the direction of the arrow Y and the opposite direction, that is, in the main scanning directions. The carriage 27 carries thereon the print heads 15/16 aligned in the main scanning directions. The print heads 15/16 eject inks for printing. The right-side print head 15 is provided with the right-side nozzles 15*a* arranged along the lower surface of the head. More specifically, the nozzles 15*a* define two rows of many nozzle openings 18 (see FIG. 6A) that are arranged in the sheet conveying direction X, and each nozzle opening 18 is equipped with a piezoelectric element.

The nozzle openings 18 in one of the two rows are filled with a magenta ink supplied from a corresponding ink bag of an ink package 8*a*. The nozzle openings 18 in the other row are filled with a black ink supplied from a corresponding ink bag of the ink package 8*a*. Similarly, the left-side print head 16 is provided with the left-side nozzles 16*a* arranged along a lower surface of the head, and each nozzle opening thereof is filled with a yellow or cyan ink. Hereinafter, yellow, magenta, cyan and black are referred to as "Y", "M", "C" and "K". Therefore, the Y, M, C and K inks are ejected from the rows of nozzle openings 18 to perform color printing.

When voltage is applied to the nozzles 15*a*/16*a* equipped with piezoelectric elements, the nozzles 15*a*/16*a* contract due to deformation proportional to the value of voltage. Upon contraction, the nozzles 15*a*/16*a* eject the inks from the nozzle openings 18 to the print sheet PP, thus performing printing.

The two generally rectangular box-shaped ink cartridges 8/9 are detachably disposed in a horizontal posture on the cartridge frames 5 within the upper space 1*a* of the portable printer 1, that is, above the print heads 15/16. The partition 5*a* extends below the ink cartridges 8/9. Of the ink cartridges 8/9, the large ink cartridge 8 disposed on the left side in FIG. 2 houses the ink package 8*a* containing the magenta and black inks. That is, the ink package 8*a* is formed by two ink bags. One of the ink bags contains the magenta ink, and the other contains the black ink.

A lower portion of the large ink cartridge 8 has a waste ink reservoir 8*b* for holding waste ink sucked by a purge operation (described below) for preventing ink clogging of the print heads 15/16.

Immediately to the right of the large ink cartridge 8 in FIG. 2, the small ink cartridge 9 is detachably disposed in a horizontal posture with the upper end thereof being flush with that of the large ink cartridge 8. Similar to the large ink cartridge 8, the small ink cartridge 9 houses an ink package 9*a* formed by two ink bags. Each ink bag contains one of the yellow and cyan inks, which are ejected from the left-side print head 16. The small ink cartridge 9 and the ink package 9*a* are smaller than the large ink cartridge 8 and the ink package 8*a*, respectively. That is, the amount of ink contained is less in the ink bags of the ink package 9*a* than in the ink bags of the ink package 8*a*. More specifically, each ink bag of the ink package 8*a* is capable containing 8 ml of ink whereas each ink bag of the ink package 9*a* is capable containing only 5.5 mil of ink. The capacities of the ink bags are thus set because of the different ink ejection amounts of the nozzles 15*a*/16*a* of the print heads 15/16.

The ink packages 8*a*/9*a* housed in the ink cartridges 8/9 are formed by generally rectangular-shaped ink bags. Each ink bag is formed by a laminate film material obtained by laminating a plurality of film sheets, for example, about ten film sheets, which are formed from a polyethylene resin or the like. The laminate film material of the ink packages 8*a*/9*a* has such great rigidity and strength as to provide the ink packages 8*a*/9*a* with a shape restoring characteristic, whereby shape changes of the ink packages 8*a*/9*a* can be curbed. Therefore, when inks are supplied from the ink packages 8*a*/9*a* to the print heads 15/16 and the amounts of inks contained in the ink packages 8*a*/9*a* decrease, the ink packages 8*a*/9*a* will not be flattened or deformed inward by the atmospheric pressure, but will maintain a suitable negative internal pressure therein.

The ink cartridges 8/9 are disposed above the print heads 15/16 for supplying inks to the print heads 15/16. Since the large ink cartridge 8 and the small ink cartridge 9 are horizontally disposed at the same height, the ink bags of the ink packages 8*a*/9*a* in the ink cartridges 8/9 are disposed on a single horizontal plane. The nozzles 15*a*/16*a* formed in the nozzle surface portions of the print heads 15/16 are also located on a single horizontal plane. Therefore, the ink bags of the ink packages 8*a*/9*a* of the four color inks and the corresponding nozzles have equal height differences. Due to the equal height differences, the hydraulic pressures on the nozzles become also equal and constant, so that the color ink nozzles have a uniform internal pressure and therefore the inks can be supplied uniformly.

The ink pressure supplied to the print heads 15/16 is kept at a uniform negative pressure, so that the each nozzle opening 18 of the nozzles 15*a*/16*a* of the print heads 15/16 has a concave meniscus (curved surface) of ink liquid. Since the internal pressure in the print heads 15/16 is maintained uniformly, the ink ejection characteristic of the nozzles 15*a*/16*a* of the print heads 15/16 can be maintained, so that good print quality can be maintained. In the case of the print heads 15/16 of this embodiment, for example, a concave meniscus of ink can be formed in each nozzle opening 18 of the nozzles 15*a*/16*a* if the supplied ink pressure is within the range (operating pressure range) of about 0 mmAq (water column) to about −300 mmAq (water column) relative to the atmospheric pressure. An optimal operating pressure range of the print heads 15/16 for the print operation by the portable printer 1 of this embodiment is from about −30 mmAq (water column) to about −100 mmAq (water column) relative to the atmospheric pressure.

A control unit 34 having a CPU, an input buffer memory, a head driving IC and the like is disposed to the left of the ink cartridges 8/9 in the upper space 1*a* of the portable printer 1 in FIG. 2. Four flexible printer cables (FPCs) 35 for applying voltages to the print heads are connected to the control unit 34. The four head driving FPCs 35 are stacked near a rearward end portion of the control unit 34 (an end portion toward the rear side in FIG. 2) in the upper space 1*a* of the portable printer 1. The head driving FPCs 35 are then laminated on the forward side (in FIG. 2) of ink supply tubes 12 (described below) near a rear end portion of the large ink cartridge 8 in the upper space 1*a* of the portable printer 1. The ink supply tubes 12 are stacked vertically and connected to the ink cartridges 8/9. The head driving FPCs 35 are film-shaped cables formed by forming a wiring pattern of an electrically conductive layer on a polyimide substrate and covering the wiring pattern with a protective layer.

Figure 4:
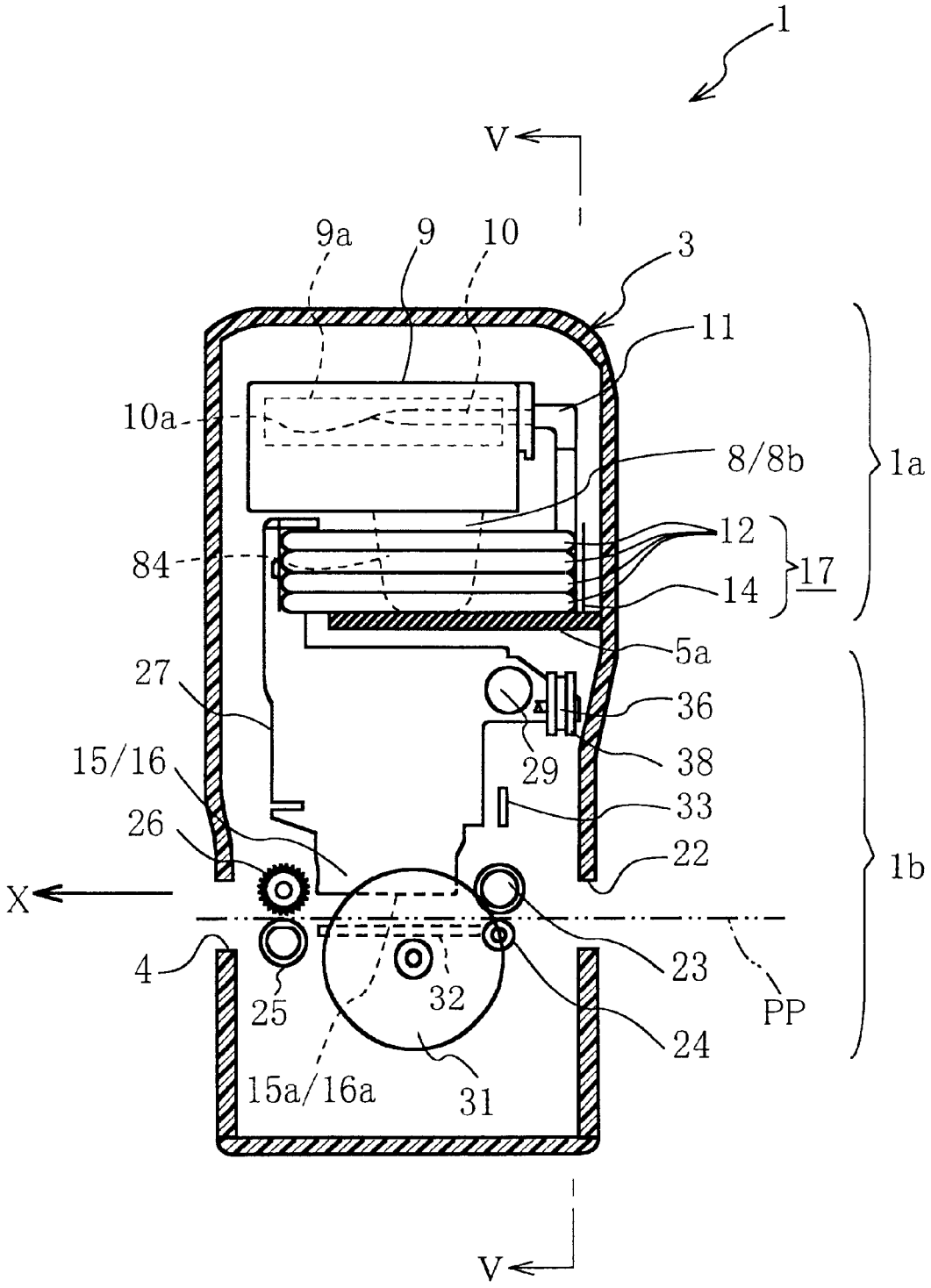
FIG. 4 is a schematic partially sectional view of the portable printer taken on line IV—IV of FIG. 1, viewed from the right-side end of the portable printer.

FIG. 4 is a schematic partially sectional view of the portable printer 1 taken on line IV—IV of FIG. 1, wherein a carriage (CR) motor 30 is omitted to simplify the illustration. As can be seen in an upper portion of the drawing of FIG. 4, ink extracting needles 10 for the individual color inks are put into the ink packages 8*a*/9*a* housed in the ink cartridges 8/9. The ink extracting needles 10, provided for extracting inks from the ink packages 8*a*/9*a*, are formed from a corrosion-resistant metallic material, such as stainless steel, a ceramic material, or the like. Each ink extracting needle 10 is a hollow needle having in its distal end portion (left-side end portion in FIG. 4) an extracting hole 10*a* for extracting an ink from the ink package 8*a* or 9*a*. The ink extracting hole 10*a* of each ink extracting needle 10 is in communication with an internal space of the needle. Therefore, when the ink extracting needles 10 are put into the ink packages 8*a*/9*a*, the inks can flow from the ink packages 8*a*/9*a* into the internal spaces of the needles via the ink extracting holes 10*a*.

In the large ink cartridge 8, a charging needle 70 (see FIG. 7) for charging waste ink sucked by the purge operation (described below) and conducted to the charging needle 70 via a waste ink tube 66 (see FIG. 7), is put into a first waste ink chamber 83. Waste ink is thereby charged into the large ink cartridge 8.

As shown in FIG. 4, a base end portion of each ink extracting needle 10 (an end portion opposite to the tip end thereof, that is, an end portion on the right side in FIG. 4) put into the corresponding one of the ink bags of the ink packages 8*a*/9*a* of the four color inks, is coupled to an end of a generally "L"-shaped coupling member 11, near the rear end of the upper space 1*a* of the portable printer 1 (the right side end thereof in FIG. 4). The other end of each coupling member 11 is connected to the corresponding one of the ink supply tubes 12. Each coupling member 11 has a hollow tubular shape, in which a communication hole (not shown) is formed for communication with the ink extracting hole 10*a* of the corresponding one of the ink extracting needles 10. The ink supply tubes 12 are generally hollow cylindrical flexible tubes formed from a synthetic resin such as polypropylene, polyethylene, polyurethane, polyvinyl chloride, or the like. The ink supply tubes 12 allow ink to flow therethrough in order to supply ink to the print heads 15/16.

In the embodiment, each ink supply tube 12 is formed by a TYGON® tube made by NORTON. The wall thickness thereof is within the range of about 0.5 mm to about 1.5 mm, and the tube inside diameter is within the range of about 0.5 mm to about 1.5 mm. Each ink supply tube 12 in this embodiment, as for example, is formed by a TYGON tube having a wall thickness of about 0.8 mm, an inside diameter of about 0.8 mm, and an outside diameter (equal to the sum of twice the wall thickness and the inside diameter) of about 2.4 mm. The minimum value of the radius R of curvature (minimum radius of curvature) of the ink supply tubes 12 in a bent state is about 20 mm.

The four ink supply tubes 12 will be further described with reference to FIGS. 2 and 4. Near a substantially central portion of the rear end portion (far end side in FIG. 2) of the upper space 1*a* of the portable printer 1, the ink supply tubes 12 connected to the ink packages 8*a*/9*a* are stacked and bundled into a vertical row by elongated rectangular annular shaped binders. The four head driving FPCs 35 stacked and connected to the control unit 34 are placed and attached onto the inward side of the curved ink supply tubes 12, that is, the forward side of a far-side portion thereof. The outward side of the curved ink supply tubes 12, that is, the rearward side of a far-side portion thereof, is covered with a protective film 14 for protecting the ink supply tubes 12 from interference with the body frame 6.

The protective film 14 is a protective member for ensuring smooth sliding of the ink supply tubes 12 on an inner wall of the body frame 6 if the ink supply tubes 12 contact the inner wall of the body frame 6. The protective film 14 is normally a film formed from a material that achieves a low surface adhesion or tackiness. The protective film 14 needs to be able to support itself or retain its shape and also needs to be able to bent together with the ink supply tubes 12 and the head driving FPCs 35 so as to follow the movements of the print heads 15/16. The thickness of the protective film 14 is preferably within the range of about 25 $\mu$m to about 300 $\mu$m. In this embodiment, the protective film 14 is formed by a polyethylene terephthalate (PET) film having a thickness of about 100 $\mu$m.

Therefore, the head driving FPCs 35, the ink supply tubes 12 and the protective film 14 are laminated in that order from the near side in FIG. 2, at a location near a substantially central portion of the rear end portion (far side in FIG. 2) of the upper space 1*a*. These members are bundled together at predetermined intervals by generally angled "8"-shaped binders 13 each of which has a wide opening and a narrow opening. The narrow opening of each binder 13 closely contacts and firmly holds the four stacked ink supply tubes 12 so as to retain the stack. The wide opening of each binder 13 is about four to five times as wide as the narrow opening. The wide opening of each binder 13 bundles the four head driving FPCs 35 so that the bundle of the head driving FPCs 35 is not greatly apart from the bundle of the four ink supply tubes 12. The wide opening of each binder 13 allows the head driving FPCs 35 to substantially freely slide therein. Therefore, the binders 13 secures an appropriate space that allows the head driving FPCs 35 to escape inward when the two bundles are bent, so that the bending thereof will not be impeded but can easily be performed. The protective film 14 is disposed on the outside of each binder 13 so as to cover the ink supply tubes 12.

The four ink supply tubes 12 and the four head driving FPCs 35 are bundled by the binders 13 at intervals of about 5 cm. The two bundles are bent from a rightward orientation toward the near-side end of the portable printer 1 in FIG. 2 on a plane of the partition 5*a* while the stacks of the bundles are maintained. At a location near the forward end portion of the upper space 1*a* (the near side thereof in FIG. 2) of the portable printer 1, the bundles are bent toward the print heads, that is, leftward in FIG. 2 since the print heads 15/16 are at an initial position that is shown leftward. The bundles are then connected to a connecting portion provided in an upper portion of the print heads 15/16. The four color inks are conducted to the designated print heads 15/16 via the corresponding ink supply tubes 12.

The ink supply tubes 12 are vertically stacked and bundled by the binders 13. This arrangement prevents the ink supply tubes 12 from hanging or bending down (downward in FIG. 2) due to gravity. Furthermore, the partition 5*a* disposed below the ink supply tubes 12 supports the four ink supply tubes 12 from below, thereby preventing the ink supply tubes 12 from hanging or bending down due to gravity. Further, the ink supply tubes 12 are substantially sandwiched by the elastic protective film 14 and the elastic head driving FPCs 35, so that the stack of the ink supply tubes 12 are prevented from bending at sharp angles, except for the aforementioned curved portion of the stack. This arrangement prevents an undesired event that the stack of the ink supply tubes 12 folds or bends at a sharp angle so that the inward sectional area of the ink passages decreases and an energy loss of the inks flowing through the ink supply tubes 12 occurs. Still further, the sandwich arrangement with the elastic members also prevents an undesired bend of the bundle of the ink supply tubes 12 on a protrusion 84 (shown in FIG. 4) of the waste ink reservoir 8*b* of the large ink cartridge 8, which is located inside the curve of the bundles of the ink supply tubes 12 and the head driving FPCs 35.

Figures 3A, 3B, 3C:
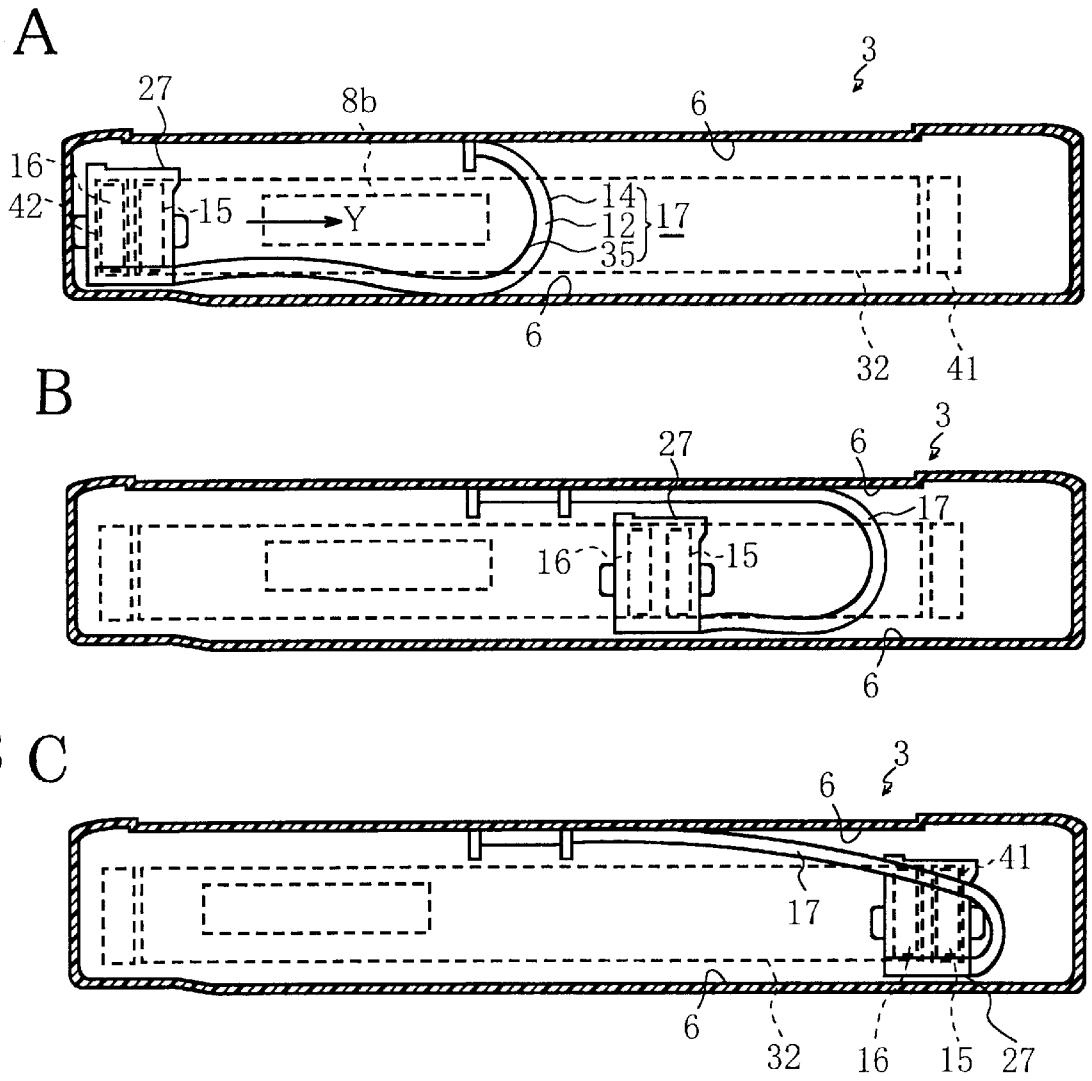
FIG. 3A is a plan sectional view of the portable printer taken on line III—III of FIG. 1, illustrating a state assumed by a harness as print heads move, wherein a carriage is at the leftmost position.
FIG. 3B is a plan sectional view of the portable printer similar to the sectional view of FIG. 3A, wherein the carriage is at an intermediate position.
FIG. 3C is a plan sectional view of the portable printer similar to the sectional view d FIG. 3A, wherein the carriage is the rightmost position.

The collective bundle of the protective film 14, the stack of the ink supply tubes 12 and the stack of the head driving FPCs 35 will hereinafter be referred to simply as "harness 17". FIGS. 3A, 3B and 3C are plan sectional views of the portable printer 1 taken on line III—III of FIG. 1, illustrating different states of the harness 17 assumed as the print heads 15/16 move. In FIGS. 3A to 3C, unrelated portions are omitted from the illustration. As shown in FIGS. 3A to 3C, the harness 17 extends from a substantially central portion of the rearward end portion of the upper space 1*a* (the far side in FIG. 2), and connects to the upper portion of the print heads 15/16. In FIGS. 3A to 3C, the direction indicated by an arrow Y is a main scanning direction.

FIG. 3A illustrates a state that the print heads 15/16 are at the initial position before printing, that is, the right-side print head 15 is at the left-side end of a platen 32 that defines a printing area 43. In the state shown in FIG. 3A, the print heads 15/16 are at a leftmost position in the drawing. In this state, the left-side print head 16 is positioned over a left-side flushing area 42. In this state, the protective film 14 of the harness 17 is pressed against the forward wall of the body frame 6 (lower side thereof in FIG. 3A) since the harness 17 tends to straighten due to its elasticity. When the CR motor 30 is operated upon application of a voltage, and therefore moves the carriage 27 together with the print heads 15/16, as shown in FIG. 2, from the aforementioned state to the right, that is, in the printing direction Y, the harness 17 connected to the print heads 15/16 is also moved following the movement of the print heads 15/16. In this case, the harness 17 moves while pressing the protective film 14 against the forward wall (lower side in FIG. 3) of the body frame 6 so that the protective film 14 slides on the forward wall of the body frame 6.

FIG. 3B illustrates a state that the carriage 27 has been moved in the direction Y. In this state, the harness 17 has progressively moved to the rearward wall (upper side in FIG. 3B) of the body frame 6, and therefore the length of the curved portion of the harness 17 has decreased so that the harness 17 is now out of the sliding contact with the forward wall (lower side in FIG. 3B) of the body frame 6. Therefore, the movement resistance of the carriage 27 has decreased, and the load on the CR motor 30 has decreased.

FIG. 3C illustrates a state that the carriage 27 has been further moved in the direction Y to the rightmost position. In this state, the right-side print head 15 is positioned over a right-side flushing area 41. In this state, the harness 17 is apart from the forward wall (lower side in FIG. 3C) of the body frame 6, so that no sliding resistance occurs with respect to the forward wall of the body frame 6.

Although the foregoing embodiment pursues a compact design of the print heads by providing rows of nozzle openings for two color inks in each print head, it is also possible to provide rows of nozzle openings for the color inks in respective print heads. Which one of the print head constructions to select is based on the balance between the production cost and the compact design requirements. Therefore, the number of print heads employed is not limited to two, but may also be more than two. A construction employing more than two print heads will be described below.

In FIG. 4, an arrow X indicates the print sheet PP conveying direction. As shown in FIG. 4, an insert opening 22 for inserting unused print sheets PP is formed in a rearward lower portion (the right side in FIG. 4) of the printer body 3. Disposed downstream of the insert opening 22 in the direction of conveyance of each print sheet PP inserted into the insert opening 22 are a conveying roller 23 for conveying each print sheet PP and a pressure roller 24 for pressing the print sheet PP against the conveying roller 23. The conveying roller 23 is driven by a line feed motor (LF motor) formed by a pulse motor. The conveying roller 23 and the pressure roller 24 cooperate to convey each print sheet PP while pressing and clamping the sheet.

Disposed downstream of the conveying roller 23 and the pressure roller 24 are a discharge roller 25 driven by the LF motor 31 for discharging the print sheet PP conveyed from the conveying roller 23 out of the printer body 3, and a pressure roller 26 for pressing the print sheet PP against the discharge roller 25. The discharge roller 25 and the pressure roller 26 cooperate to discharge each print sheet PP via the sheet discharge opening 4.

The print heads 15/16 are disposed over the print sheet PP positioned between the conveying roller 23 and the discharge roller 25. The print heads 15/16 are detachably mounted to the carriage 27 movable back and forth in directions substantially perpendicular to the sheet of the drawing of FIG. 4, that is, the direction indicated by the arrow Y in FIG. 2 and the opposite direction, along a guide bar 29 supported by the body frame 6 of the printer body 3. The surfaces of the print heads 15/16 facing the print sheet PP have the nozzles 15*a*/16*a* for ejecting the inks to the print sheet PP held by the conveying roller 23 and the like.

The carriage 27 carrying thereon the print heads 15/16 will be described with reference to FIGS. 2 to 4. The carriage 27 disposed in the lower space 1*b* of the printer body 3 is supported by the guide bar 29, which extends through a rear portion of the carriage 27 (a right-side portion thereof in FIG. 4) in the main scanning directions. The carriage 27 is movable in the main scanning directions, guided by the guide bar 29. A drive pulley 38 is connected to a rotating shaft of the CR motor 30 disposed at a right-side end in the portable printer 1 in FIG. 2. The drive pulley 38 and a driven pulley 39 disposed at a left-side end in FIG. 2 are connected by a timing belt 36. The carriage 27 is fixed to a portion of the timing belt 36. When a voltage is applied to the CR motor 30 by the control unit 34, the CR motor 30 operates to rotate the drive pulley 38 and therefore the timing belt 36. In this manner, the carriage 27 is moved along the guide bar 29 in the main scanning directions (the direction of the arrow Y in FIG. 2 and the opposite direction).

A timing fence 33 for recognizing the position of the carriage 27 is provided on the rear side of the carriage 27 (the right side thereof in FIG. 4). The timing fence 33 is a linear type encoder formed by a finely slitted glass plate. Two photosensors (not shown) are provided which are slightly shifted in phase from each other. Each photosensor is formed by a combination of a light emitter formed by a light-emitting diode (LED) and a light receiver formed by a photo-transistor. In each photosensor, the light emitter and the light receiver are disposed at the opposite sides of the timing fence 33. An origin detecting photosensor is also provided. The position of the carriage 27 is detected by the light receiver (not shown) of each photosensor detecting light traveling from the light emitter (not shown) via the timing fence 33. The phase difference between the aforementioned two photosensors is set to ½ of the phase of the slits so as to detect the moving direction of the carriage 27. The aforementioned origin detecting photosensor is used to detect the original position of the carriage 27. The data based on pulses obtained from the photosensors are accumulated and analyzed by the CPU of the control unit 34 so as to perform increment-type control for detection of the position of the carriage 27. The transmission-type timing fence 33 may be replaced by a reflection-type timing fence. In such a case, the timing fence 33 is formed by a plate of aluminum or the like on which fine stripes are printed or baked, and the position of the carriage 27 is detected by a laser light emitter emitting light to the timing fence 33 and a light receiver detecting light reflected from the timing fence 33. It is also possible to employ a timing fence having absolute-type graduations.

The CR motor 30 is a direct-current (DC) motor, and can be controlled in speed through PWM control or DC value control. Based on the positional information from the timing fence 33, the present position of the carriage 27 is recognized, and the speed and the acceleration of the carriage 27 are determined. Based on the thus-obtained date, feedback control through PDI control is performed.

Figure 5:
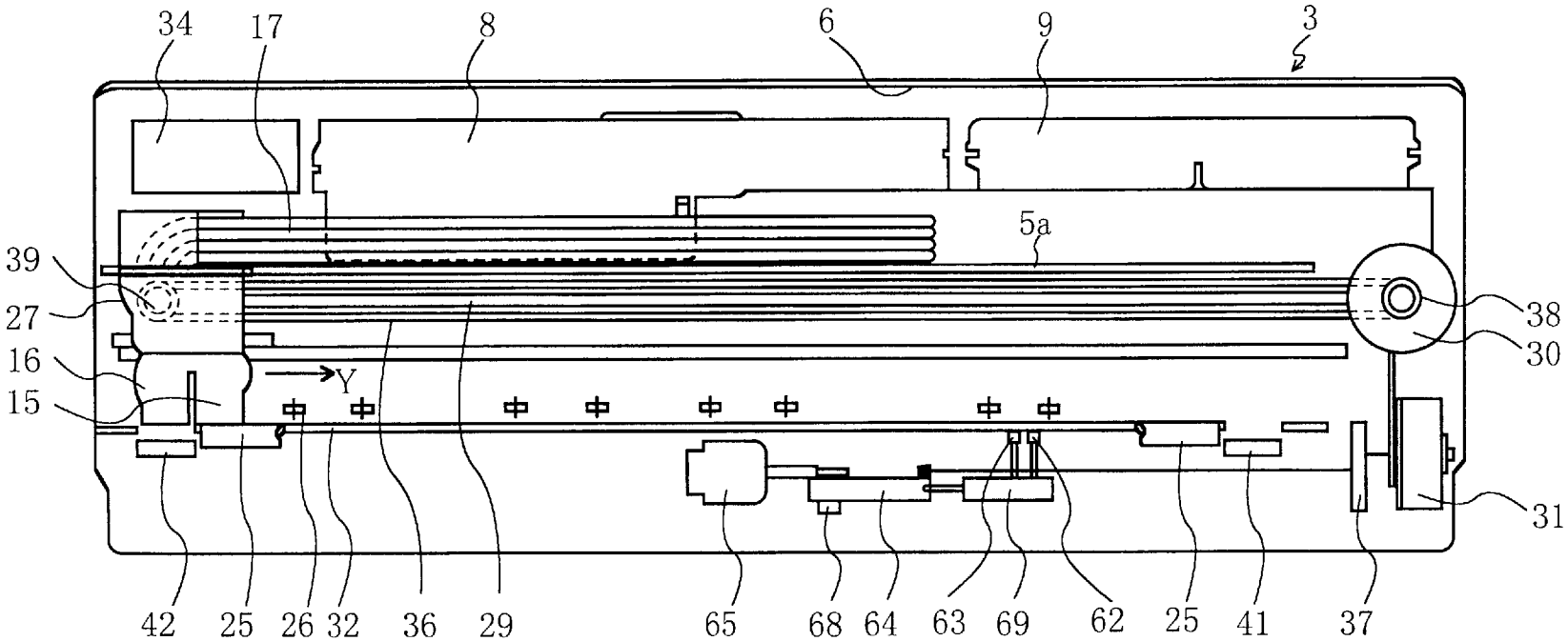
FIG. 5 is a schematic sectional view of the portable printer taken on line V—V of FIG. 1, viewed from the right-side end of the portable printer.

FIG. 5 is a sectional view of the portable printer 1 taken on line V—V in FIG. 4. In FIG. 5, an arrow Y indicates a direction of movement of the carriage 27. As shown in FIG. 5, the CR motor 30 for supplying drive forces to reciprocate the carriage 27 in the right-to-left directions in FIG. 5 (the direction of the arrow Y and the opposite direction) is disposed on an upper portion of the body frame 6, in a right-side portion of the printer body 3. Disposed below the CR motor 30 is the LF motor 31 for rotating the conveying roller 23 and the discharge roller 25.

The flushing operation will now be described. The print heads 15/16 (ink jet heads) for ejecting inks from the nozzle openings 18 employ inks each of which contains a fast drying solvent in order to ensure fast drying and fixation of the inks on a print sheet PP after the inks are ejected thereto. When the portable printer 1 is not used, the nozzles 15*a*/16*a* are covered with a first cap 62 and a second cap 63 (hereinafter, referred to as "caps 62/63 ") to prevent the inks in the nozzle openings 18 from drying. In the case of monochrome printing, ink is constantly ejected, so that ink in the nozzle openings is constantly refreshed. Therefore, an ink viscosity increase due to the drying of ink normally does not occur in monochrome printing.

In the case of color printing, however, some of the color inks can be left unused for a long time. An ink that is not ejected from but remains in the nozzle openings 18 exposed to external air for a relatively long time is likely to dry and have an increased viscosity. Therefore, nozzle openings 18 for a certain color ink may become clogged during a long-time printing operation. Therefore, a flushing area is provided for withdrawing the print heads 15/16 from the platen 32 corresponding to the printing area 43, that is, from the area of a print sheet PP. When the printing operation has continued for a predetermined length of time, the print heads 15/16 are withdrawn into the flushing area, and then the inks are ejected to a pre-disposed ink absorber in order to renew ink whose viscosity has increased due to long-time dwelling in nozzle openings 18. The clogging of the nozzle openings 18 is thereby prevented. The portable printer 1 of the embodiment performs the flushing operation at the start and end of each printing operation and at every elapse of ten seconds during the printing operation.

A flushing mechanism according to the embodiment will be described. FIG. 3A illustrates the state that the carriage 27 is at the leftmost position in the drawing. In this state, the left-side print head 16 is positioned directly over the left-side flushing area 42, and the right-side print head 15 is positioned over the left-side end of the platen 32. The width of the platen 32 measured in the direction Y is substantially equal to the maximum print sheet PP width that allows the printing by the portable printer 1, so that if a print sheet PP of the maximum width is used, printing can be performed by the right-side print head 15 at the position over the left-side end of the platen 32. If ink is ejected from the left-side nozzles 16*a* of the left-side print head 16 in the state shown in FIG. 3A, ink deposits on a left-side absorber 42*a* that is disposed in the left-side flushing area 42. The left-side absorber 42*a* is formed by a mass of fibers that embraces many gap spaces, so that ink is quickly absorbed upon deposition on the left-side absorber 42*a*.

When the left-side print head 16 is positioned in the left-side flushing area 42 as shown in FIG. 3A, the right-side print head 15 can start printing in the printing area 43 while the left-side print head 16 is performing the flushing operation. Therefore, the flushing operation can be performed without stopping the printing operation. That is, the flushing operation can be performed without degrading the throughput of the printing apparatus.

FIG. 3C shows the state that the carriage 27 is at the rightmost position in the drawing. In this state, the right-side print head 15 is positioned directly over the right-side flushing area 41, and the left-side print head 16 is positioned over the right-side end of the platen 32. In this state, therefore, the right-side print head 15 can perform the flushing operation in the right-side flushing area 41, and the left-side print head 16 can perform printing if the print sheet PP extends under the left-side print head 16. That is, it is possible to perform the flushing operation of the right-side print head 15 while performing the printing operation.

Figure 6A:
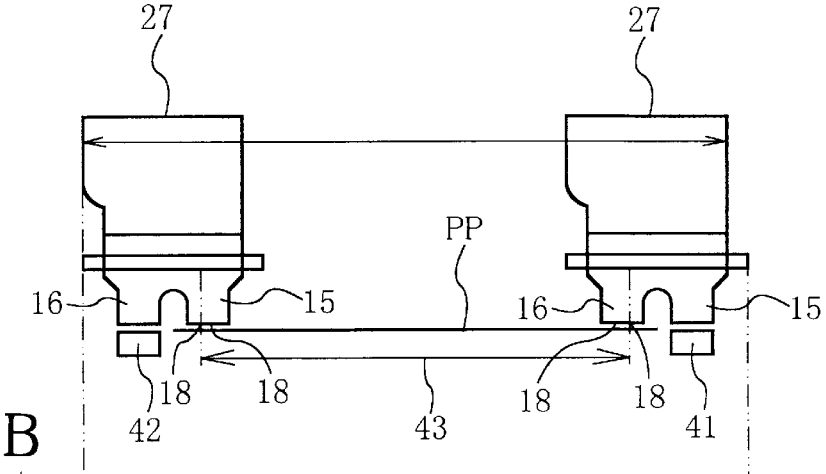
FIG. 6A illustrates a positional relationship between the carriage carrying thereon the print heads, a printing area, a print sheet, and a flushing area.
Figures 8A, 8B, 8C, 8D, 8E, 8F:
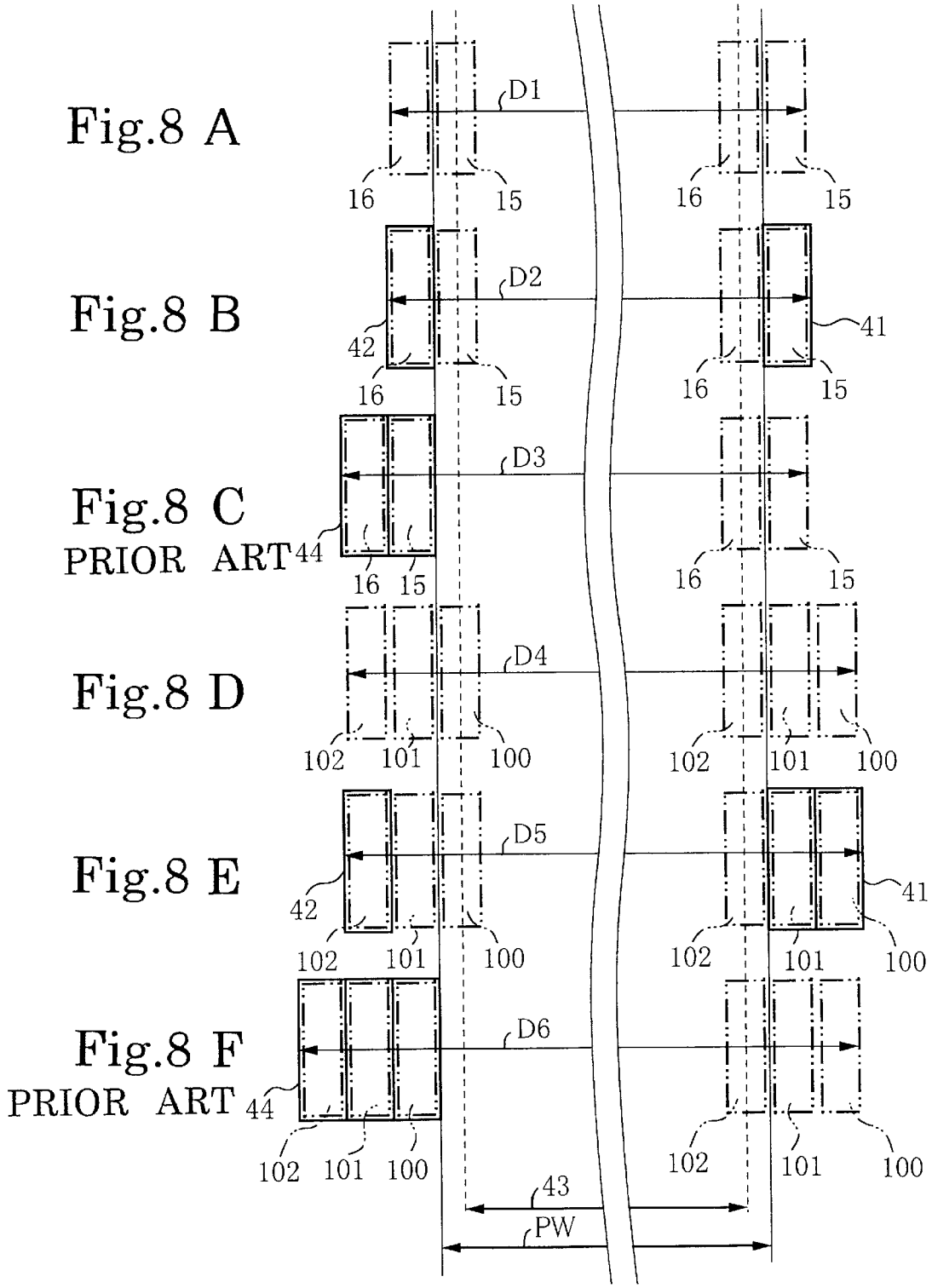
Fig.8 C PRIOR ART
Fig.8 F PRIOR ART
FIGS. 8A, 8B, 8D and 8E illustrate the width PW of a print sheet, the printing area, and the width of a space needed for the print heads to print in the printing area and perform the flushing operation in first and second embodiments.
FIGS. 8C and 8F illustrate the width PW of a print sheet, the printing area, and the width of a space needed for the print heads to print in the printing area and perform the flushing operation in conventional printers.

The flushing operation will be described in detail with reference to FIGS. 6A, 6B, 8A, 8B and 8C. FIG. 6A illustrates a positional relationship between the carriage 27 carrying thereon the print heads 15/16, the printing area 43, the print sheet PP, and the right-side flushing area 41 and the left-side flushing area 42 (hereinafter, referred to as "flushing areas 41/42"). FIG. 6A and FIG. 8B show the case of the portable printer 1 of the embodiment where the flushing areas cannot be integrated into a single area but need to be provided separately at the left and right positions. Since the portable printer 1 has two print heads, that is, the right-side print head 15 and the left-side print head 16, the print heads 15/16 are moved as described below if the print sheet PP has the maximum width. Assuming that printing is started at the left-side end of the printing area 43 of the print sheet PP, it is necessary to move the carriage 27 to such a position that the nozzle openings 18 of the left-side print head 16 are positioned over the left-side end of the printing area 43 (see FIGS. 6A and 8A). This position depends on the margin of the print sheet PP. Assuming that the minimum margin width is about 5 mm and the distance between the centers of the right-side print head 15 and the left-side print head 16 is about 10 mm, the left-side print head 16 is positioned leftward of the left-side end of the print sheet PP when the right-side print head 15 starts printing at the left-side end of the print sheet PP. In this case, therefore, the left-side print head 16 is not positioned over the print sheet PP but positioned over the left-side flushing area 42. That is, in the case where the right-side print head 15 starts printing at the left-side end of the print sheet PP under the foregoing conditions, the flushing of the left-side print head 16 can be performed without a need to further move the left-side print head 16 to the left-side flushing area 42.

Similarly, considering that the printing is completed at the right-side end of the printing area 43 of the print sheet PP, it is necessary to move the carriage 27 until the nozzle openings 18 of the left-side print head 16 are positioned at the right-side end of the printing area 43. If the left-side print head 16 completes the printing at the right-side end of the print sheet PP, the right-side print head 15 becomes positioned rightward of the right-side end of the print sheet PP, that is, the right-side print head 15 is positioned not over the print sheet PP but over the right-side flushing area 41. Therefore, when the left-side print head 16 completes the printing at the right-side end of the printing area 43 of the print sheet PP under the foregoing conditions, the flushing of the right-side print head 15 can be performed without a need to further move right-side print head 15 to the right-side flushing area 41.

Figure 6B:
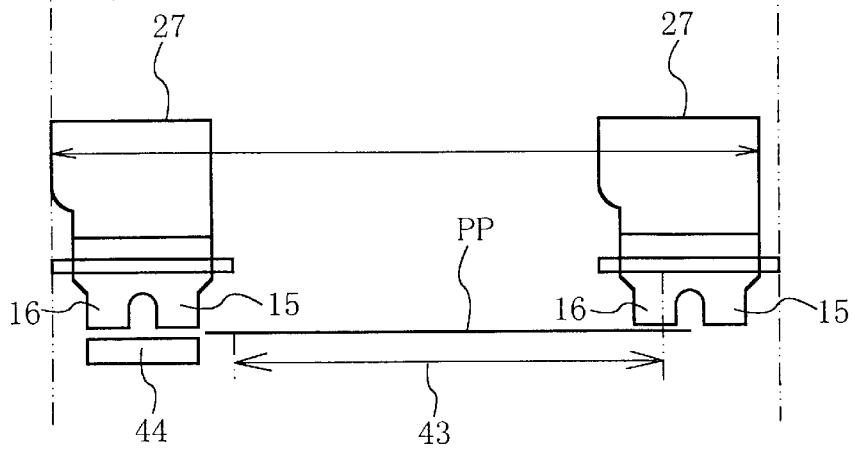
Fig.6 B PRIOR ART
FIG. 6B illustrates a positional relationship between the carriage carrying thereon the print heads, a printing area, a print sheet, and a flushing area, with respect to conventional printers.

In comparison with the above-described flushing mechanism of the portable printer 1 of the embodiment, a conventional flushing mechanism will be described. FIGS. 6B and 8C show the case of a printer wherein an integrated flushing area is provided outwardly of the left-side end of the printing area 43. In this case, in order to perform the flushing of two print heads, that is, a right-side print head 15 and a left-side print head 16, it is necessary to completely withdraw the right-side print head 15 from the printing area 43 into a flushing area 44. Therefore, the conventional mechanism needs to move the print heads farther leftward in FIG. 8C than the mechanism of the embodiment. Assuming that the distance between the heads is about 10 mm, the conventional mechanism needs to move the heads 10 mm farther leftward than the mechanism of the embodiment.

Considering that the printing is completed at the right-side end of the printing area 43 of the print sheet PP, the conventional mechanism also needs to move the carriage 27 until the nozzle openings 18 of the left-side print head 16 are positioned at the right-side end of the printing area 43. If the left-side print head 16 completes the printing at the right-side end of the print sheet PP, it is necessary to move the right-side print head 15 rightward of the right-side end of the print sheet PP. That is, in order to print up to the right-side end of the print sheet PP in the conventional printer, the carriage 27 needs to be moved to the same position as in the embodiment even though the flushing operation is not performed outwardly of the right-side end of the printing area 43 in the conventional printer.

As is apparent from the above comparison, the portable printer 1 of the embodiment needs to move the carriage 27 over a shorter distance for the flushing operation than the conventional printer. Therefore, the width of the printer body 3 can be reduced corresponding to the aforementioned reduction in the necessary moving distance of the carriage 27. The embodiment thus reduces the size of the space for the movements of the carriage 27, which is a bottleneck in the pursuit of miniaturization of the portable printer 1, without degrading the flushing mechanism.

The purge operation and a mechanism therefore will be described. Similar to the flushing operation, the purge operation is mainly intended to prevent the clogging of the nozzles 15*a*/16*a* of the print heads 15/16. Whereas the flushing operation is periodically performed during printing to eject ink from the nozzles 15*a*/16*a* in the flushing areas 41/42 for the purpose of preventing the nozzles 15*a*/16*a* from drying, the purge operation is performed to forcibly discharge ink from the print heads 15/16 if the ink viscosity is so high that the flushing operation cannot discharge ink. When the printer is not used, the print heads 15/16 are covered with the caps 62/63 in order to substantially prevent the print heads 15/16 from drying. However, the actual sealing of the caps 62/63 is not perfect, so that ink in the print heads 15/16 gradually dries although the heads are covered with the caps 62/63. Therefore, if the printer is left unused for a long time, ink in the nozzles 15*a*/16*a* may become dry and viscous so that the ink cannot be discharged by the flushing operation. In such a case, a suction pump is operated to forcibly discharge the highly viscous ink from the nozzles 15*a*/16*a*.

Figure 7:
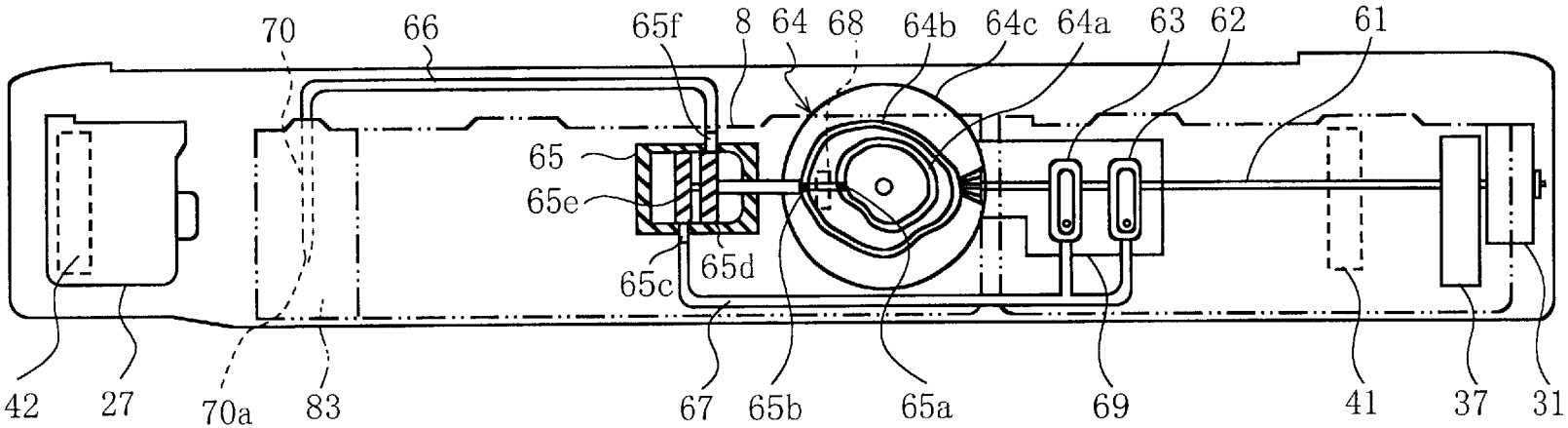
FIG. 7 is a plan partially sectional view of the portable printer taken on line VI—VI of FIG. 1.

The purge mechanism of the embodiment will be described with reference to FIG. 7. FIG. 7 is a plan partially sectional view of the portable printer 1 of the embodiment taken on line VI—VI in FIG. 1, wherein a pump 65 is shown in a sectional view and an irrelevant portion is omitted from the illustration. The LF motor 31 for conveying the print sheet PP operates upon application of a voltage thereto. For purging, drive power is transmitted from the LF motor gear 37 to a pump driving gear 61 via an LF motor gear 37. Drive power is then transmitted from the pump driving gear 61 to a pump driving cam 64 via a bevel gear provided on a distal end of the pump driving gear 61, so that the pump driving cam 64 is rotated. The pump driving cam 64 is a hollow cylindrical member that is open downward. The pump driving cam 64 has on its upper surface a bevel gear that meshes with the bevel gear of the pump driving gear 61. The pump driving cam 64 has an inner guide groove 64*a* and an outer guide groove 64*b* each of which has a modified annular configuration. Another groove (side groove) 64*c* extends around a peripheral surface of the pump driving cam 64. A protrusion (not shown) corresponding to a photosensor 68 is provided on an inner lower surface of the opening of the pump driving cam 64. The protrusion is detected by the photosensor 68, so that the initial position of the pump driving cam 64 is detected.

The pump 65 is disposed to the left of the pump driving cam 64 in FIG. 7. The pump 65 has two pistons, that is, a first piston 65*d* and a second piston 65*e*. The first piston 65*d* has a tubular rod whose distal end is provided with an outer follower 65*b* that is a driven portion guided by the outer groove 64*b*. The second piston 65*e* has a rod that extends through the tubular rod of the first piston 65*d*. The distal end of the rod of the second piston 65*e* is provided with an inner follower 65*a* that is a driven portion guided by the inner groove 64*a*. The pump 65 has an inlet 65*c* and an outlet 65*f* that is formed in an upper right portion of the pump 65. The inlet 65*c* is connected to a purge tube 67. The purge tube 67 is connected in communication to the caps 62/63. Therefore, the purge operation is performed simultaneously for the first cap 62 and the second cap 63. The outlet 65*f* of the pump 65 is connected to a waste ink tube 66 that is connected in communication to the waste ink reservoir 8*b* of the large ink cartridge 8. Therefore, all the color inks are held as waste ink in the waste ink reservoir 8*b* of the large ink cartridge 8.

The first cap 62 and the second cap 63 are disposed to the right of the pump driving cam 64. The caps 62/63 are moved by a driven element (not shown) guided by the side groove 64*c* formed in the peripheral surface of the pump driving cam 64 when the pump driving cam 64 is rotated. The caps 62/63 are raised and lowered by a cap raising/lowering portion 69.

The purge operation will be described in detail with reference to FIG. 7. When purging is necessary, voltage is applied to the CR motor 30 (see FIG. 2) by a predetermined control device in order to move the carriage 27. When the print heads 15/16 are moved to a position over the caps 62/63, the position of the print heads 15/16 is detected by the timing fence 33, and the purge operation is started. Rotation is transmitted from the LF motor 31 to the pump driving cam 64 by the LF motor gear 37, and the pump driving cam 64 rotates from the initial position. Therefore, the driven element is moved by the side groove 64*c* of the pump driving cam 64 so as to move the cap raising/lowering portion 69. The caps 62/63 are thereby raised to tightly cover the surfaces of the nozzles 15*a*/16*a* of the print heads 15/16.

When being at the initial positions, the first piston 65*d* and the second piston 65*e* are substantially in contact with each other. The first piston 65*d* closes the outlet 65*f* when at the initial position. The second piston 65*e* closes the inlet 65*c* when at the initial position. Subsequently, the first piston 65*d*, the second piston 65*e* and the cap raising/lowering portion 69 operate as described below, guided by the pump driving cam 64.

After the caps 62/63 are raised, the second piston 65*e* is moved leftward and the distance between the first piston 65*d* and the second piston 65*e* increases. Therefore, the capacity defined between the two pistons increases while negative pressure grows therein. Simultaneously, the inlet 65*c* becomes open from the closed state previously achieved by the first piston 65*d*. Due to the negative pressure caused by the pump 65, a negative pressure also occurs in the caps 62/63 by communication through the purge tube 67. Therefore, ink is sucked and discharged from the nozzle openings 18 into the spaces defined by the caps 62/63. The discharged ink flows from the caps 62/63 into the pump 65 via the purge tube 67 and the inlet 65*c* of the pump 65. The ink is then stored in the space defined between the first piston 65*d* and the second piston 65*e*. When a predetermined amount of ink flows into the pump 65, negative pressure disappears. After a slight delay, the caps 62/63 are lowered below the plane of the platen 32 (see FIG. 4) by the cap raising/lowering portion 69, and the print heads 15/16 are kept uncovered.

After that, the first piston 65*d* and the second piston 65*e* are simultaneously moved to the right while the interval between the two pistons is kept constant. Therefore, during the movement of the pistons, the pressure in the space between the pistons remains constant, so that ink will not be sucked through the inlet 65*c* nor discharged therethrough back into the purge tube 67 or the caps 62/63. Then, the second piston 65*e* closes the inlet 65*c*, and the first piston 65*d* moves away from the outlet 65*f* and therefore opens the outlet 65*f*. The first piston 65*d* is then stopped while the second piston 65*e* is moved further rightward, so that the interval between the first piston 65*d* and the second piston 65*e* decreases and the capacity defined therebetween also decreases. Therefore, the waste ink stored in the pump 65 is pressurized and discharged via the outlet 65*f*. The discharged waste ink flows through the waste ink tube 66 and enters the waste ink reservoir 8*b* of the large ink cartridge 8. The first piston 65*d* and the second piston 65*e* are then moved together leftward, remaining substantially in contact with each other. The first piston 65*d* and the second piston 65*e* are stopped at such a position that the first piston 65*d* closes the outlet 65*f* and the second piston 65*e* closes the inlet 65*c*.

Finally, the protrusion (not shown) provided in a lower portion of the pump driving cam 64 is detected by the photosensor 68, and the end of the purge operation is indicated to the control unit 34. Then, the power transmission from the LF motor 31 to the pump driving gear 61 is discontinued by disengaging the LF motor gear 37, so that the pump driving cam 64 stops rotating at the initial position. The purge operation is thus completed.

The method of operating the portable printer 1 will be described with reference to FIGS. 2 and 4. A cartridge member is set into the body frame 6, and the print heads 15/16 provided in the cartridge member is set on the carriage 27 provided in the printer body 3. When the power is turned on after the ink cartridges 8/9 have been set, the purge operation of sucking inks from the nozzle openings 18 to discharge dry ink or ink containing air bubbles or dust or the like before printing is started, in order to ensure good quality printing. As the initial position at the time of power-on, the nozzles 15*a*/16*a* of the print heads 15/16 are tightly covered with the caps 62/63. Therefore, drive power is transmitted from the LF motor 31 to the pump driving gear 61 via the LF motor gear 37 to perform the purge operation.

After that, the operation of the carriage 27 is checked, and the carriage 27 is stopped at the initial position for the start of printing. When an unused print sheet PP is inserted into the insert opening 22 of the portable printer 1, the print sheet PP is conveyed below the print heads 15/16 by the pressure roller 24 and the conveying roller 23 rotated by the LF motor 31. When the print sheet PP passes under the print heads 15/16 movable back and forth in the main scanning directions, that is, the direction of the arrow Y and the opposite direction, the print sheet PP is printed by inks ejected from the nozzles 15*a*/16*a* of the print heads 15/16.

The four color inks flow from the ink packages 8*a*/9*a* of the ink cartridges 8/9 into the corresponding ink extracting needles 10 put into the ink packages 8*a*/9*a*, via the extracting holes of the ink extracting needles 10. The inks flow from the ink extracting needles 10 into the four ink supply tubes 12 via the communication openings (not shown) of the coupling members 11. The inks are thus supplied into the print heads 15/16, so that the inks can be ejected from the nozzles 15*a*/ 16*a* of the print heads 15/16. After printing, the printed print sheet PP is discharged out of the sheet discharge opening 4 by the pressure roller 26 and the discharge roller 25 rotated by the LF motor 31

As described above, the print heads 15/16, set on the carriage 27 driven by the CR motor 30, perform printing by ejecting the inks from the nozzles 15*a*/16*a* while being moved back and forth in the lower space 1*b* of the portable printer 1 in the direction of the arrow Y in FIG. 2 and the opposite direction. As the print heads 15/16 set on the carriage 27 are reciprocated in this manner, the four ink supply tubes 12 connected to the upper portion of the print heads 15/16 are also moved back and forth. When the print heads 15/16 are moved into a right-side portion (right side in FIG. 2) of the lower space 1*b* of the portable printer 1, portions of the ink supply tubes 12 closer to the print heads 15/16 are curved. The curved portion (bent or folded portion) of the stack of the ink supply tubes 12 is supported by the partition 5*a* disposed in the upper space 1*a* of the portable printer 1. The ink supply tubes 12 are curved toward the connecting portion provided in the upper portion of the print heads 15/16 disposed in the upper space 1*a* of the portable printer 1.

The flushing operation is performed at the start and end of printing and at every elapse of about 10 seconds during printing, by withdrawing the print heads 15/16 into either one of the flushing areas.

After printing, the carriage 27 is stopped at a position over the caps 62/63, and then the purge operation is performed once by transmitting drive power from the LF motor 31 to the pump driving gear 61 via the LF motor gear 37. The caps 62/63 are raised and stopped to tightly cover the nozzles 15*a*/16*a* in order to prevent the nozzles 15*a*/16*a* from drying while the nozzles 15*a*/16*a* are left unoperated.

As described above, the flushing areas 41/42 having areas corresponding to the two print heads 15/16 are separately provided on the right and left sides of the printing area 43, instead of providing a single flushing area, in the embodiment of the invention. Therefore, the embodiment is advantageously capable of performing the flushing operation within the moving area of the carriage 27 that is needed for normal printing. Thus, it becomes unnecessary to separately provide a moving area of the carriage 27 for the flushing operation. Furthermore, the embodiment makes it possible to construct a printing apparatus capable of performing the flushing operation to prevent the clogging of the print heads while securing only the carriage moving area needed for printing. Therefore, it becomes possible to provide a compact printing apparatus capable of producing high-quality printing.

Further, since the flushing operation of either one of the print heads 15/16 can be performed simultaneously with the printing operation of the other print head, the embodiment is able to perform the flushing operation without stopping the printing operation. Therefore, the time consumed solely for the flushing operation can be reduced, and the throughput time can be reduced.

Further, since the embodiment employs, as an ink collecting device, the absorbers 41*a*/42*a* each formed by a mass of fibers embracing many gap spaces, the embodiment allows simple construction related to the flushing areas 41/42. Therefore, it becomes possible to provide a compact printing apparatus capable of producing high-quality printing.

Although in the embodiment, the portable printer 1 has the two print heads 15/16, the invention is not restricted by the number of print heads. For example, the invention may also have construction as described below.

A second embodiment of the invention that has three print heads will be described below.

FIGS. 8A to 8F illustrate the print sheet width PW, the printing area 43, the width of a space needed for the movements of print heads that perform the flushing operation and the printing operation in the printing area 43. The three print heads are a right-side print head 100, a middle print head 101 and a left-side print head 102. In this printer, the width of movements of the print heads 100/101/102 that is needed to properly print on a print sheet of the width PW is a width D4 as indicated in FIG. 8D. That is, at the leftmost position of the print heads 100/101/102, the right-side print head 100 is positioned at the left-side end of the printing area 43. At the rightmost position, the left-side print head 102 is positioned at the right-side end of the printing area 43. Thus, the moving width of the print heads 100/101/102 needed for printing is the width D4.

In the second embodiment employing the flushing mechanism, the width of movements of the print heads 100/101/102 needed to perform the flushing operation is a width D5 as indicated in FIG. 8E. That is, at the leftmost position of the print heads 100/101/102, the right-side print head 100 is positioned at the left-side end of the printing area 43. At the rightmost position, the left-side print head 102 is positioned at the right-side end of the printing area 43. A left-side flushing area 42 may be provided so as to perform the flushing operation of the left-side print head 102 when the print heads 100/101/102 are at the rightmost position. In this case, it is necessary to provide a right-side flushing area 41 for performing the flushing operation of the right-side print head 100 and the left-side print head 102 when the print heads 100/101/102 are at the rightmost position. Thus, the moving width of the print heads 100/101/102 needed to perform the flushing operation of the print heads is the width D5. The width D5 equals the aforementioned width D4, which means that there is no need for a special space for providing flushing areas. It is also possible to provide a left-side flushing area 42 for two of the print heads 100/101/102 and a right-side flushing area 41 for the other one of the print heads. This modification is the same in principle as the second embodiment, and will not be further described.

In a conventional printer wherein only one flushing area is provided on a side of the printing area 43, the width of movements of the print heads needed for the flushing operation is as follows. FIG. 8F indicates a width of movements of the print heads needed in a conventional printer wherein a single flushing area 44 is provided. In order to perform the flushing operation of three print heads 100/101/102 in the conventional printer, it is necessary to withdraw all the print heads from the print sheet width PW into the flushing area 44. Therefore, the flushing area 44 must be provided for performing the flushing operation of the three print heads, for example, on the left side of the print sheet width PW. Since the flushing operation is not performed on the right side of the print sheet width PW in this case, the rightmost position of the print heads may be the same as that indicated in FIG. 8D. In the conventional printer, therefore, the width of movements of the print heads needed for the flushing operation and the printing operation becomes a width D6 as indicated in FIG. 8F. The width D6 is greater than the width D5, approximately by the width of one print head. Consequently, the second embodiment needs a less amount of movements of the print heads than the conventional printer adopting the flushing area 44 provided on one side of the print sheet width PW.

Figures 9A, 9B, 9C, 9D:
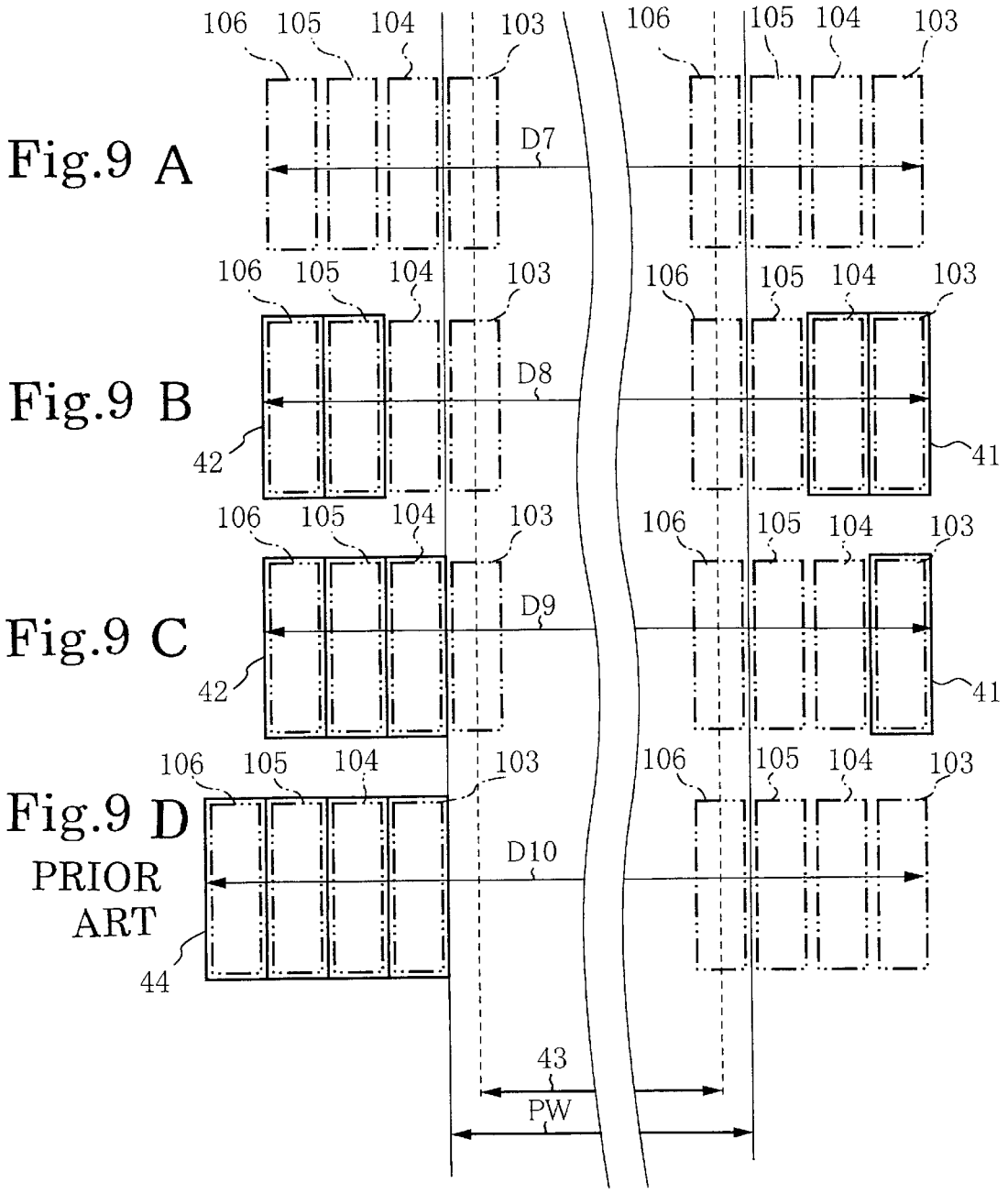
Fig.9 D PRIOR ART
FIGS. 9A–9C illustrate the width PW of a print sheet, the printing area, and the width of a space needed for the print heads to print in the printing area and perform the flushing operation in a third embodiment.
FIG. 9D illustrates the width PW of a print sheet, the printing area, and the width of a space needed for the print heads to print in the printing area and perform the flushing operation in conventional printers.

FIGS. 9A to 9D also illustrate the print sheet width PW, the printing area 43, the width of a space needed for the movements of print heads that perform the flushing operation and the printing operation in the printing area 43. With reference to FIGS. 9A to 9D, a third embodiment employing four print heads will be described. In this embodiment, flushing areas 41/42 can be provided in two manners, that is, in a manner such that the flushing operation is performed on two of the four print heads on each side of the print sheet width PW or a manner such that the flushing operation is performed on one of the four print heads on one side and for the other three print heads on the other side. The two manners will be separately described. The four print heads are a rightmost print head 103, a middle right print head 104, a middle left print head 105, and a leftmost print head 106. The range of movements of the print heads 103/104/105/106 will first be considered in a case where a flushing area is not provided. In this case, at the leftmost position of the print heads 103/104/105/106, the rightmost print head 103 is positioned at the left-side end of the printing area 43. At the rightmost position of the print heads 103/104/105/106, the leftmost print head 106 is positioned at the right-side end of the printing area 43. Therefore, the moving distance needed for the print heads 103/104/105/106 to perform printing becomes a width D7 as indicated in FIG. 9A.

If flushing areas are provided for two of the four print heads on each side in the third embodiment, the flushing areas 41/42 are provided as indicated in FIG. 9B, within the range indicated in FIG. 9A. If flushing areas are provided for performing the flushing operation of three of the four print heads on the right side of the print sheet width PW and the other one print head on the right side, the flushing areas 41/42 are provided as indicated in FIG. 9C, within the range indicated in FIG. 9A. If flushing areas are provided for one of the print heads on the left side and the other three print heads on the right side, the flushing areas 41/42 can be similarly provided within the range indicated in FIG. 9A.

Therefore, the width needed for the movements of the print heads 103/104/105/106 becomes a width D8 as indicated in FIG. 9B or a width D9 as indicated in FIG. 9C. Each of the width D8 and the width D9 equals the width D7 indicated in FIG. 9A.

In contrast, if a single flushing area for all the four print heads is provided as in a conventional printer, it is necessary to secure a flushing area 44 for the four print heads on one side of the print sheet width PW, for example, the left side thereof as indicated in FIG. 9D, because all the print heads 103/104/105/106 must be withdrawn from the area of the print sheet width PW. Therefore, the width needed for the movements of the print heads 103/104/105/106 becomes a width D10 as indicated in FIG. 9D. The width D10 is greater than the width D8, D9, approximately by the width of a print head.

As described above in conjunction with the second and third embodiments, the invention is not limited to a printer having two print heads as in the first embodiment, but may also be applied if the number of print heads is three or more.

While the invention has been described with reference to the embodiments, it is to be understood that the invention is not restricted to the particular forms shown in the foregoing embodiments. Various modifications and alternations can be made thereto without departing from the scope of the invention.

For example, although the foregoing embodiments employ ink jet type print heads, the invention is not limited to ink jet type print heads, but may also be applied to other types of print heads that eject ink for printing.

The flushing operation cannot be performed in the area for purging if the purge area is provided within the printing area 43 as in the foregoing embodiments. However, if the purge area is provided outside the printing area 43, it is possible to adopt a construction in which the flushing operation is performed in the purge area in order to eliminate the need to provide ink absorbers for the flushing operation. For example, if the caps for the purge operation are disposed in a purge area provided at the position of the left-side flushing area 42, the flushing operation can be performed by ejecting ink from the print heads into the caps.

As is apparent from the foregoing description, the printing apparatus of the invention is capable of performing the flushing operation within the range of movements of the carriage needed for normal printing since the apparatus adopts divided flushing areas that are provided on both sides of the range, instead of a single flushing area having an area corresponding to all the print heads. Therefore, it becomes unnecessary to separately provide a moving range of the carriage for the flushing operation. Furthermore, since the invention makes it possible to construct a printing apparatus capable of performing the flushing operation to prevent the clogging of the print heads while securing only the carriage moving area needed for printing. Therefore, it becomes possible to provide a compact easy-to-carry printing apparatus capable of producing high-quality printing.

If the number of print heads is two, the printing apparatus of the invention sets divided flushing areas on both sides so that the flushing operation is performed on one of the two print heads in each flushing area. Therefore, the printing apparatus of the invention needs a smaller range of movements of the carriage than a conventional printer wherein a single flushing area for the two print heads is provided on one side. Therefore, it becomes possible to provide a compact printing apparatus capable of producing high-quality printing.

If the number of print heads is three, the printing apparatus of the invention sets divided flushing areas on both sides so that the flushing operation is performed on one of the three print heads in one of the flushing areas and on the other two print heads in the other flushing area. Therefore, the printing apparatus of the invention needs a smaller range of movements of the carriage than a conventional printer wherein a single flushing area for all the three print heads is provided on one side. Therefore, it becomes possible to provide a compact printing apparatus capable of producing high-quality printing.

If the number of print heads is four, the printing apparatus of the invention may set divided flushing areas on both sides so that the flushing operation is performed on two of the four print heads in each flushing area. Therefore, the printing apparatus of the invention needs a smaller range of movements of the carriage than a conventional printer wherein a single flushing area for all the four print heads is provided on one side. Therefore, it becomes possible to provide a compact printing apparatus capable of producing high-quality printing.

Furthermore, if the number of print heads is four, the printing apparatus of the invention may also set divided flushing areas on both sides so that the flushing operation is performed on one of the four print heads in one of the flushing areas and on the other three print heads in the other flushing area. Therefore, the printing apparatus of the invention needs a smaller range of movements of the carriage than a conventional printer wherein a single flushing area for all the four print heads is provided on one side. Therefore, it becomes possible to provide a compact printing apparatus capable of producing high-quality printing.

The printing apparatus of the invention also achieves an advantage that the flushing operation can be performed without stopping the printing operation. Therefore, the time consumed solely for the flushing operation can be reduced, and the throughput time can be reduced.

Furthermore, by employing ink absorbers having many gap spaces as ink collecting devices, the invention advantageously makes it possible to provide a simple construction of the flushing areas. Therefore, it becomes possible to provide a compact printing apparatus capable of producing high-quality printing.

Further, if the printing apparatus has a purge mechanism, the area for the purge operation can be used for the flushing operation according to the invention. Therefore, it becomes possible to perform the flushing operation without separately providing a flushing area.

What is claimed is:

1. A printing apparatus comprising:

a carriage being reciprocatable in main scanning directions and being capable of carrying thereon print heads aligned in the main scanning directions;

a control unit that executes a flushing operation on the printheads;

an ink collecting device that collects waste ink ejected from the print heads during the flushing operation;

a cleaning device that cleans a nozzle opening by ejecting ink from a nozzle of the print heads during the flushing operation;

a first flushing area provided beyond an end of a printing area where the print heads are moved in the main scanning directions, provided with the ink collecting device, and having an area corresponding to at least one print head of the print heads; and a second flushing area provided beyond another end of the printing area, provided with the ink collecting device and having an area corresponding to the print heads excluding the at least one print head, wherein a number of the print heads is three, the first flushing area has an area corresponding to one of the print heads, and the second flushing area has an area corresponding to the other two of the print heads.

2. The printing apparatus according to claim 1, wherein the flushing operation of at least one print head of the print heads is performed simultaneously with a printing operation of the print heads other than the at least one print head.

3. A printing apparatus comprising:

a carriage being reciprocatable in main scanning directions and being capable of carrying thereon print heads aligned in the main scanning directions;

a control unit that executes a flushing operation on the print heads;

an ink collecting device that collects waste ink ejected from the print heads during the flushing operation;

a cleaning device that cleans a nozzle opening by ejecting ink from a nozzle of the print heads during the flushing operation;

a first flushing area provided beyond an end of a printing area where the print heads are moved in the main scanning directions, provided with the ink collecting device, and having an area corresponding to at least one print head of the print heads; and a second flushing area provided beyond another end of the printing area, provided with the ink collecting device and having an area corresponding to the print heads excluding the at least one print head, wherein a number of the print heads is four, the first flushing area has an area corresponding to two of the print heads, and the second flushing area has an area corresponding to the other two of the print heads.

4. The printing apparatus according to claim 3, wherein the flushing operation of at least one print head of the print heads is performed simultaneously with a printing operation of the print heads other than the at least one print head.

5. A printing apparatus comprising:

a carriage being reciprocatable in main scanning directions and being capable of carrying thereon print heads aligned in the main scanning directions;

a control unit that executes a flushing operation on the print heads;

an ink collecting device that collects waste ink ejected from the print heads during the flushing operation;

a cleaning device that cleans a nozzle opening by ejecting ink from a nozzle of the print heads during the flushing operation;

a first flushing area provided beyond an end of a printing area where the print heads are moved in the main scanning directions, provided with the ink collecting device, and having an area corresponding to at least one print head of the print heads; and a second flushing area provided beyond another end of the printing area, provided with the ink collecting device and having an area corresponding to the print heads excluding the at least one print head, wherein a number of the print heads is four, the first flushing area has an area corresponding to one of the print heads, and the second flushing area has an area corresponding to the other three of the print heads.

6. The printing apparatus according to claim 5, wherein the flushing operation of at least one print head of the print heads is performed simultaneously with a printing operation of the print heads other than the at least one print head.

7. A method of operating a printing apparatus, the printing apparatus having a carriage being reciprocatable in main scanning directions and being capable of carrying thereon print heads aligned in the main scanning directions, the method comprising:

controlling the printing apparatus to perform a flushing operation;

cleaning a nozzle opening by ejecting ink from a nozzle of the print heads during the flushing operation; and collecting waste ink ejected from the print heads in an ink collecting device during the flushing operation, wherein cleaning and collecting steps are performed in a first flushing area provided beyond an end of a printing area where the print heads are moved in the main scanning directions, provided with the ink collecting device, and having an area corresponding to at least one print head of the print heads, and a second flushing area provided beyond another end of the printing area, provided with the ink collecting device and having an area corresponding to the print heads excluding the at least one print head, wherein a number of the print heads is three, the first flushing area has an area corresponding to one of the print heads, and the second flushing area has an area corresponding to the other two of the print heads.

8. A method of operating a printing apparatus, the printing apparatus having a carriage being reciprocatable in main scanning directions and being capable of carrying thereon print heads aligned in the main scanning directions, the method comprising:

controlling the printing apparatus to perform a flushing operation;

cleaning a nozzle opening by ejecting ink from a nozzle of the print heads during the flushing operation; and collecting waste ink ejected from the print heads in an ink collecting device during the flushing operation, wherein cleaning and collecting steps are performed in a first flushing area provided beyond an end of a printing area where the print heads are moved in the main scanning directions, provided with the ink collecting device, and having an area corresponding to at least one print head of the print heads, and a second flushing area provided beyond another end of the printing area, provided with the ink collecting device and having an area corresponding to the print heads excluding the at least one print head, wherein a number of the print heads is four, the first flushing area has an area corresponding to two of the print heads, and the second flushing area has an area corresponding to the other two of the print heads.

* * * * *

UNITED STATES PATENT AND TRADEMARK OFFICE

CERTIFICATE OF CORRECTION

PATENT NO. : 6,276,778 B1
DATED : August 21, 2001
INVENTOR(S) : Yoshiki Katayama It is certified that error appears in the above-identified patent and that said Letters Patent is hereby corrected as shown below:

Title page,
Item [57], change line 9 to read as follows:

-- [57] ABSTRACT
embodiment, a first flushing area for the flushing operation is --

Signed and Sealed this

Twenty-sixth Day of February, 2002

*Attest:*

*Attesting Officer*

JAMES E. ROGAN
*Director of the United States Patent and Trademark Office*